US010465308B2

(12) United States Patent
Mardilovich et al.

(10) Patent No.: US 10,465,308 B2
(45) Date of Patent: Nov. 5, 2019

(54) ADHESION-PROMOTING SURFACE

(71) Applicant: HEWLETT-PACKARD DEVELOPMENT COMPANY, L.P., Houston, TX (US)

(72) Inventors: Peter Mardilovich, Cambridge (GB); Anthony M. Fuller, Corvallis, OR (US); Qingqiao Wei, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 84 days.

(21) Appl. No.: 15/674,618

(22) Filed: Aug. 11, 2017

(65) Prior Publication Data

US 2017/0342580 A1 Nov. 30, 2017

Related U.S. Application Data

(62) Division of application No. 13/878,204, filed as application No. PCT/US2010/053517 on Oct. 21, 2010, now abandoned.

(51) Int. Cl.
*C25D 1/00* (2006.01)
*C25D 11/04* (2006.01)
(Continued)

(52) U.S. Cl.
CPC ..... *C25D 1/006* (2013.01); *C23C 28/00* (2013.01); *C23C 28/321* (2013.01);
(Continued)

(58) Field of Classification Search
CPC ..... A61F 2/0077; C25D 1/006; C25D 11/24; C25D 11/12; C25D 11/045; C23C 28/3455; C23C 28/322; C23C 28/321; C23C 28/00
See application file for complete search history.

(56) References Cited

U.S. PATENT DOCUMENTS 4,197,135 A 4/1980 Bailey
5,013,383 A 5/1991 Chapman
(Continued)

FOREIGN PATENT DOCUMENTS

JP 200173166 3/2001
WO WO-2009053714 4/2009
WO WO-2010022107 2/2010

OTHER PUBLICATIONS

Mozalev, A., et al. (2003), Nucleation and growth of the nanostructured anodic oxides on tantalum and niobium under the porous alumina film. Electrochimica Acta, 48(Electrochemistry in Molecular and Microscopic Dimensions), 3155-3170. doi:10.1016/S0013-4686(03)00345-1.
(Continued)

*Primary Examiner* — Francisco W Tschen
(74) *Attorney, Agent, or Firm* — HP Inc. Patent Department

(57) ABSTRACT

A method of adhering a cover layer to a substrate includes forming an array of nano-structures on a substrate. A flowable material is applied to the substrate, the flowable material substantially enveloping the nano-structures on the substrate. The flowable material is solidified to form a cover layer on the substrate, the cover layer being anchored to the substrate via the nano-structures.

12 Claims, 5 Drawing Sheets

(51) Int. Cl.
*C25D 11/12* (2006.01)
*C25D 11/24* (2006.01)
*C23C 28/00* (2006.01)

(52) U.S. Cl.
CPC ..... *C23C 28/322* (2013.01); *C23C 28/3455* (2013.01); *C25D 11/045* (2013.01); *C25D 11/12* (2013.01); *C25D 11/24* (2013.01)

(56) References Cited

U.S. PATENT DOCUMENTS 5,485,185 A * 1/1996 Sueoka ..... B41J 2/14072 347/64
5,980,682 A 11/1999 Gibson et al.
6,358,354 B1 3/2002 Patil
6,770,353 B1 8/2004 Mardilovich
7,175,723 B2 2/2007 Jones et al.
7,229,685 B2 6/2007 Full et al.
7,691,307 B2 4/2010 Fearing et al.
7,695,811 B2 4/2010 Northen et al.
2002/0021339 A1 2/2002 Higuma et al.
2003/0136505 A1 7/2003 Wimmer
2004/0032468 A1 2/2004 Killmeier
2005/0133910 A1 6/2005 Riedl et al.
2006/0202355 A1 9/2006 Majidi et al.
2007/0251570 A1 11/2007 Eckert et al.
2008/0035943 A1 2/2008 Slutsky et al.
2008/0236659 A1 10/2008 Monden et al.
2008/0292840 A1 11/2008 Majumdar et al.
2009/0034122 A1 2/2009 Ichihara
2010/0132772 A1 6/2010 Asano et al.
2010/0291385 A1* 11/2010 Greer ..... B81C 1/00031 428/398
2011/0021965 A1* 1/2011 Karp ..... A61F 2/0077 602/54

OTHER PUBLICATIONS

Shreir, L.L. Jarman, R.A. Burstein, G.T.. (1994). Corrosion (3rd Edition) vols. 1-2-5.5 Tantalum. Elsevier. Online version available at: app.knovel.com/hotlink/pdf/id:kt002ZB3Q3/corrosion-3rd-edition/tantalum.

* cited by examiner

ADHESION-PROMOTING SURFACE

CROSS-REFERENCE TO RELATED APPLICATIONS

This application is a divisional of co-pending U.S. application Ser. No. 13/878,204, filed Apr. 6, 2013, which is itself a 371 national stage filing of International application S.N. PCT/US2010/053517, filed Oct. 21, 2010, each of which is incorporated herein by reference in its entirety.

BACKGROUND

The present disclosure relates generally to adhesion to surfaces, and more particularly, to the formation of nano-structures on a surface to promote adhesion.

Adhesive bonding is an alternative to the more traditional mechanical fastening methods of joining materials, such as nails, rivets, and screws. One of the major differences between an adhesive joint and mechanical fastening is that, generally, in mechanical fastening one or both of the parts or materials being held together is pierced by a mechanical fastener, whereas an adhesive joint may be formed without the piercing the materials. This leads to one of the advantages of adhesives over mechanical fastening, namely the ability to, not only fasten different materials, but to also to form a seal between components in a single step. Mechanical fastening typically requires separate sealing and fastening steps to create a sealed part.

For example, in the area of microfluidics, the utilization of separate mechanical fasteners and sealants or gaskets would result in larger, more expensive, and less efficient devices compared to that obtainable using an adhesive. Adhesives also provide an advantage in fastening dissimilar materials together, from the standpoint of fastening materials such as glasses, ceramics, and silicon devices, in which forming the holes to allow fasteners to be utilized is difficult and expensive.

In an inkjet printing system, a printhead structure may include a number of discrete components connected via adhesive joints to define a printing fluid path. The adhesive joints may be exposed to potentially corrosive printing fluids which, over time, may tend to weaken the adhesive joints, particularly at the interface between the adhesive and the surface. Where an adhesive joint fails, printing fluids may penetrate into regions where there is active circuitry, leading to corrosion or electrical shorting, or both.

BRIEF DESCRIPTION OF THE DRAWINGS

Features and advantages of embodiments of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Figure 1:
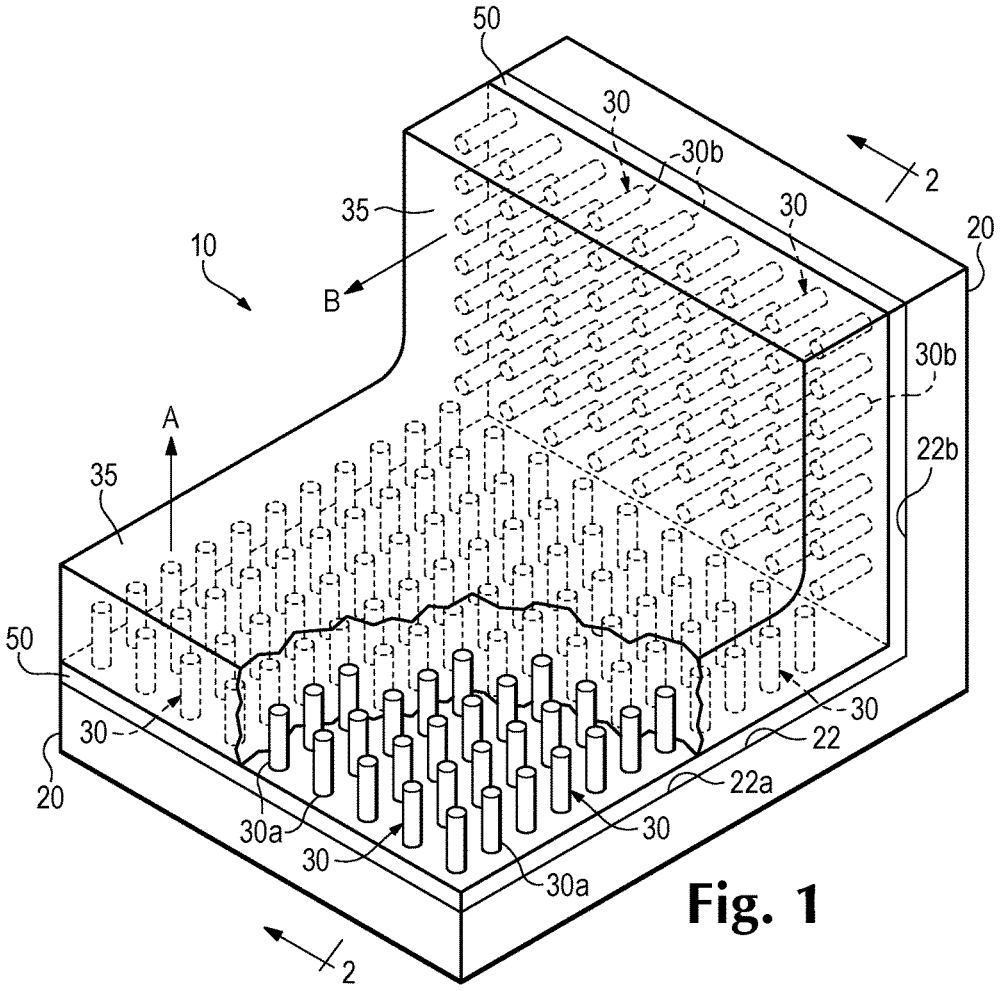
FIG. 1 is a perspective view of a schematic depiction of an article formed in accordance with an embodiment of the present invention.

Referring initially to FIG. 1, an article 10 is shown, the depicted article including a substrate 20. In accordance with our teachings, substrate 20 defines a surface 22 with an array of nano-structures 30 formed thereon, the nano-structures being configured to enhance surface adhesion of the substrate.

Figure 2:
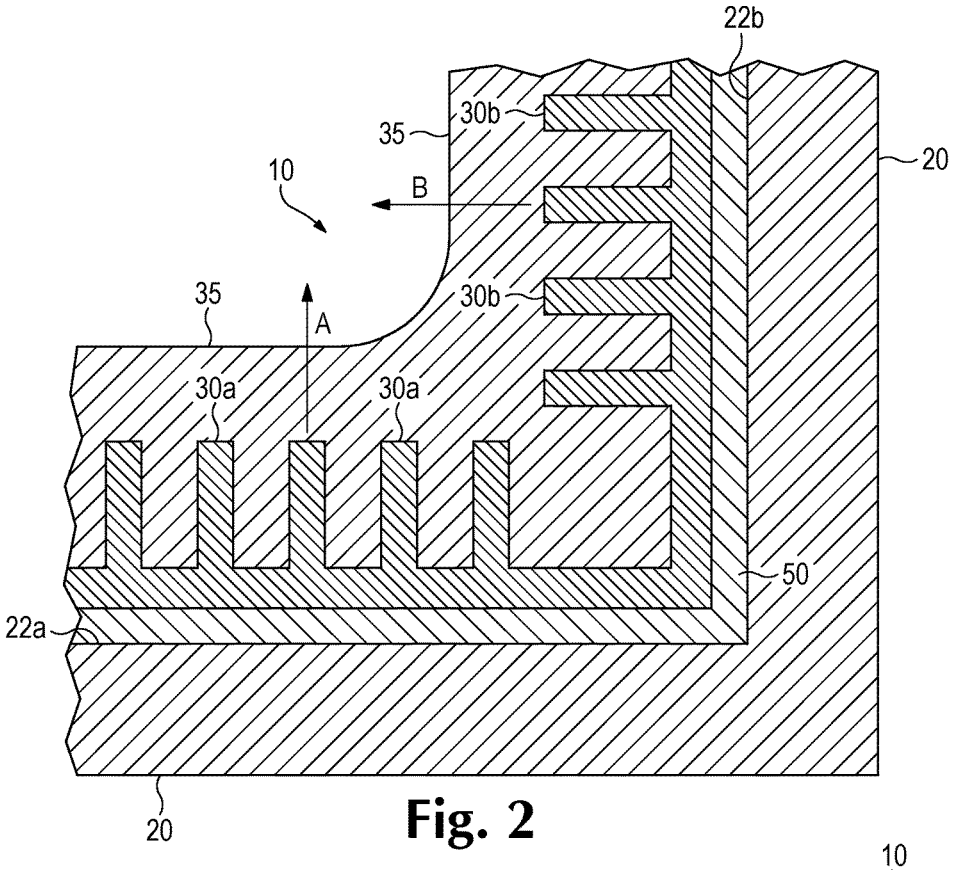
FIG. 2 is a cross-sectional view of the article shown in FIG. 1, taken generally along line 2-2 of FIG. 1.

As shown in FIGS. 1 and 2, surface 22 may be a multi-faceted surface, and thus may define a first surface region 22*a* and a second surface region 22*b*. The first and second surface regions intersect at an angle that is less than 180 degrees. In the present example, the first and second surface regions intersect at an angle of approximately 90 degrees.

Nano-structures 30 extend substantially orthogonally from the substrate surface 22. More particularly, a first set of nano-structures 30*a* extend substantially orthogonally from first surface region 22*a* in a first direction (A) and a second set of nano-structures 30*b* extend substantially orthogonally from second surface region 22*a* in a second direction (B). Nano-structures may be formed on substantially all of respective surface regions, or may be formed on only a portion (or portions) of the surface regions, depending on the particular adhesion requirements. In the present example, because the angle between first surface region 22*a* and second surface region 22*b* is less than 180 degrees, it will be understood that first direction (A) intersects second direction (B).

As indicated, a cover layer 35 may be applied to at least a portion of substrate surface 22, the cover layer typically being applied as a flowable material that substantially envelops nano-structures 30. In some embodiments, cover layer 35 may take the form of an adhesive such as SU-8, which is an epoxy-based negative photoresist manufactured by MicroChem Corporation. SU-8 is commonly used in the fabrication of microfluidic devices such as printer printheads. Once applied, the SU-8 may be solidified (e.g., by curing), securing the cover layer to the substrate surface 22 though chemical and/or mechanical means. Although an SU-8 cover layer is described in the present examples, cover layers formed of other materials may similarly be employed.

A variety of factors may contribute to securement of cover layer 35 to the substrate 20. For example, because substrate surface 22 includes nano-structures 30, the surface area of the substrate surface is increased relative to the surface area of a smooth substrate surface (e.g., an otherwise identical substrate surface without nano-structures 30 formed thereon). The taller the nano-structures, the greater the surface area of substrate surface 22 that will be exposed to contact with cover layer 35. This increased surface area may provide a greater area for chemical bonding between the cover layer 35 and the substrate surface 22. Also, the chemistry of the nano-structures may be changed to accommodate chemical bonding by, for example, applying a thin layer of a suitable adhesion-promoting material to the nano-structures by techniques such as atomic layer deposition, adsorption, impregnation-sintering, etc.

Where the substrate includes intersecting surface regions (as shown in FIGS. 1 and 2), the nano-structures also may act to mechanically lock the cover layer to the substrate. Referring to FIG. 2, for example, it will be noted that the nano-structures 30*a* may restrict movement of the cover layer in the second direction (B), and that nano-structures 30*b* restrict movement of flowable material 35 in the first direction (A). Such restrictions are due, at least in part, to the reliable formation of nano-structures that extend substantially orthogonal to the substrate surfaces along intersecting trajectories. Such nano-structures oppose interface shift (also referred to as "shear") between the cover layer and the substrate surface in intersecting planes, thus locking cover layer 35 in place.

Figure 3:
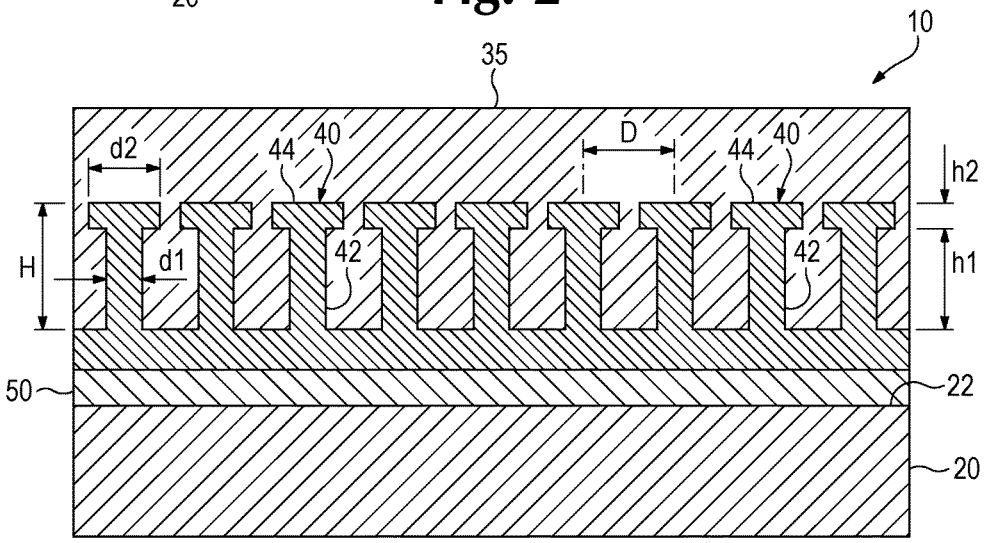
FIG. 3 is a cross-sectional view of an article including an array of capped nano-structures formed in accordance with an embodiment of the present invention.

FIG. 3 shows yet another feature that may contribute to securement of cover layer 35 to the substrate 20. As indicated, substrate 20 may be provided with nano-structures 40 having geometries that promote mechanical anchoring of the cover layer 35 to the substrate. For example, nano-structures 40 may take the form of capped nano-pillars, having stem portions 42 and cap portions 44. Stem portions 42 may be characterized as having a stem diameter (d1), and cap portions may be characterized as having a cap diameter (d2), where the stem diameter is narrower than the cap diameter. Cap portions thus will tend to resist movement of the cover layer in a direction away from substrate 20.

Methods disclosed herein may be used to control various properties of the nano-structures so as to promote adhesion through chemical bonding and/or mechanical anchoring. For example, nano-structures may be reliably formed orthogonal to the substrate surface, regardless of the morphology, geometry and/or orientation of the substrate. Nano-structures also may be reliably formed with geometries and/or dimensions (e.g., height, shape, etc.) that promote adhesion of the cover layer to the substrate. Even placement of the nano-structures may be controlled using the methods disclosed herein.

The geometry of the nano-structures may be controlled so that the nano-structures have substantially uniform shape. Similarly, as shown in FIG. 2, the nano-structures may be substantially uniform in height (H), and the pitch of the nano-structures (the center-to-center distance between nano-structures (D)) may be substantially uniform. Nano-structures 40 thus may be substantially uniformly spaced across at least a portion of the substrate surface, providing a substantially uniform nano-structured surface. Dimensions of nano-structures generally will vary by less than 10% to 20% (for nanometer scale dimensions), and in some examples, may vary by as little as 1% or 2%.

Referring to FIG. 3, it will be appreciated that nano-structures 40 each include an elongate stem portion 42 extending from the substrate and an elongate cap portion 44 extending from the stem portion. The example stem portions take the form of cylindrical columns, each generally characterized as having a stem diameter (d1) and a stem height (h1). Stem portions 42 may have substantially uniform stem heights (h1), and may have substantially uniform stem thicknesses (represented by stem diameter (d1)) along such stem heights. The example cap portions 44 similarly take the form of cylindrical columns, each generally characterized as having a cap diameter (d2) and a cap height (h2). Cap portions 44 also may have substantially uniform cap heights (h2), and may have substantially uniform thicknesses (represented by cap diameter (d2)) along such cap heights.

In the depicted example, the stem diameters (d1) are less than the cap diameters (d2), giving the nano-structures a generally "T" shape. Such T-shaped nano-structures may enhance adhesive properties of the substrate, the broader caps serving to mechanically anchor cover layer 35 to substrate 20. Although the example nano-structures have stem heights (h1) that are greater than cap heights (h2), cap height (h2) may be greater than stem height (h1). The nano-structures similarly may have other geometries, which may be determined at least in part by parameters of the fabrication process described below.

FIGS. 4A-4G depict an article 10 through various stages of fabrication. As shown, a substrate 20 thus may be adapted, through the present method, to include a nano-structured surface that includes an array of capped nano-structures. Although a particular nano-structure geometry is shown, it will be understood that the fabrication process parameters may be altered to achieve different nano-structure geometries.

Figure 4A:
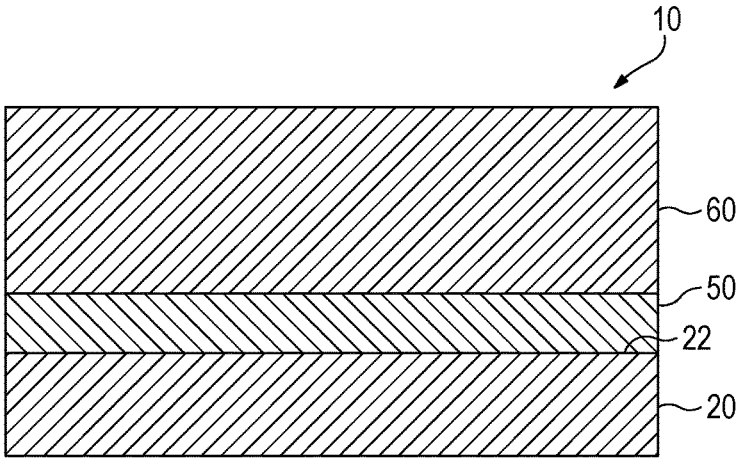
FIGS. 4A through 4G schematically depict a method for fabricating an article having adhesion-promoting nano-structures formed in accordance with an embodiment of the present invention.

Referring initially to FIG. 4A, fabrication begins with a substrate 20 having a surface 22. Substrate 20 may be selected based, at least in part, on the application for which article 10 will ultimately be used. If, for example, article 10 is to be used in a printer printhead (where semiconductor devices are to be formed on the substrate), the substrate may be formed from suitable support structures for semiconductors, such as a substantially planar silicon wafer.

Substrate 20 similarly may be formed from other materials, e.g., glass, quartz, alumina, stainless steel, plastic, and/or the like, and may take any of a variety of forms, including a multilayer structure and/or a structure with a non-planar surface (as shown in FIGS. 1 and 2). In the present example, a substantially planar substrate is shown (meaning that the surface is flat but may contain some irregularities).

As shown, a first oxidizable material is deposited on substrate 20 to form a layer of first oxidizable material 50. The first oxidizable material layer 50 may be formed using any suitable deposition technique known in the art. Some non-limiting examples of suitable deposition techniques include physical vapor deposition (PVD) (such as sputtering, thermal evaporation and pulsed laser deposition), atomic layer deposition (ALD), or, in some instances, chemical vapor deposition (CVD).

In some examples, the first oxidizable material layer 50 may be formed of a metal or metal alloy that forms a dense metal oxide after electrochemical oxidation. Suitable oxidizable materials include oxidizable refractory metals such as tantalum (Ta), niobium (Nb), titanium (Ti), tungsten (W), or their alloys. Such oxidizable materials all can be electrochemically and/or thermally oxidized, and all have expansion coefficients (the ratio between thickness of the grown oxide and thickness of the consumed material) that are greater than 1.

In the present example, first oxidizable material layer 50 is formed of tantalum (Ta), which has been found suitable for use in the methods described herein. The example first oxidizable material layer also is referred to herein as the "Ta layer". The Ta layer may have any suitable thickness that will produce (during electrochemical oxidation) enough oxide to form the nano-structures (which will be described in further detail below). In some examples, the thickness of the Ta layer may be approximately 100 to 1000 nanometers.

Referring still to FIG. 4A, it will be noted that a second oxidizable material is deposited on the Ta layer to form a layer of second oxidizable material 60. The second oxidizable material layer may have a thickness selected to produce a porous oxide (as described below), which corresponds to the desired nano-structures to be formed. The second oxidizable material may be aluminum (Al), or may be an aluminum alloy such as an alloy having aluminum as the main component. Second oxidizable material layer 60 also is referred to herein as the "Al layer". The Al layer may have any suitable thickness that will produce (during electrochemical oxidation) enough oxide to form a template sufficient to produce the intended nano-structures. In some examples, the thickness of the Al layer may be approximately 10 to 1000 nanometers.

Deposition of the second oxidizable material layer on the first oxidizable material layer may be accomplished using any suitable deposition technique known in the art. Some non-limiting examples of suitable deposition techniques include physical vapor deposition (PVD) (such as sputtering, thermal evaporation and pulsed laser deposition.

Figure 4B:
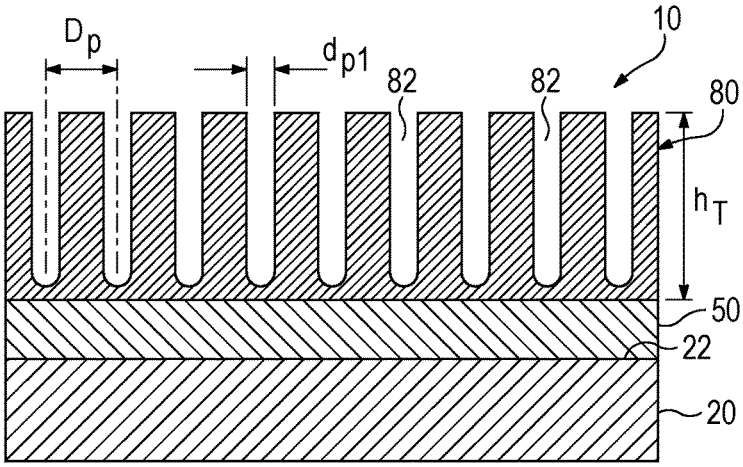

As shown generally in FIG. 4B, the multi-layer structure of FIG. 4A may be further processed to form a nano-structure template 80 on substrate 20. The nano-structure template defines a plurality of nano-pores 82, each having a first width (indicated as nano-pore diameter ($d_{p1}$), in the present example). Such nano-pores are suitable for use in forming nano-structures on the substrate, as will be described herein.

In some examples, further processing includes a first anodization process whereby second oxidizable material layer 60 (FIG. 4A) is anodized to define a plurality of substantially uniform, cylindrical nano-pores 82. Such nano-pores may be formed by completely anodizing the second oxidizable material layer 60 (e.g., the Al layer) so as to produce a nano-structure template 80 in the form of a layer of porous oxide (e.g., anodic porous alumina, $Al_2O_3$) with nano-pores 82. Complete anodization refers to the oxidation sufficiently through the thickness of the layer being anodized to allow anodization of underlying first oxidizable material layer 50, as will be described below.

Anodization (i.e., electrochemical oxidation) is a process of forming an oxide layer on a material by making the material the anode in an electrolytic cell and passing an electric current through the cell. Nano-pores are formed by field-assisted dissolving of the anode material (e.g., aluminum). Because field-assistant dissolving of anodic alumina starts from the alumina-aluminum interface, the resulting pores are reliably orthogonal to the substrate surface, regardless of the morphology, geometry and/or orientation of the substrate surface. For anodization of aluminum, as in the present example, applied voltage may be kept constant at voltage within a range of about 10V to 200V. In some examples, the first anodization process may occur at a voltage of about 30V.

Geometry of the nano-structure template 80 may be adjusted by varying one or more of anodization voltage, current density and electrolyte. Such adjustments to the first anodization process may alter nano-pore pitch ($D_p$) and/or nano-pore diameter ($d_{p1}$), which characteristics are illustrated in FIG. 4B. For example, nano-pore pitch may be related to anodization voltage, where nanometer pitch ($D_p$) is 2.8 nanometres per volt of anodization voltage. Nano-pore pitch ($D_p$) generally may be adjusted within a range of from about 30 nanometers to about 500 nanometers. Nano-pore diameter ($d_{p1}$) generally may be adjusted within a range of from about 10 nanometers to about 350 nanometers.

Anodization can be performed at constant current (galvanostatic regime), at constant voltage (potentiostatic regime) or at some combination of these regimes. Nano-pore diameter ($d_{p1}$) is proportional to anodization voltage. Accordingly, a potentiostatic regime may be employed to produce a porous substrate with nano-pores having substantially uniform nano-pore diameter ($d_{p1}$). Substantially uniform nano-pores 82, in turn, will yield substantially uniform nano-structures 40, as will be described below.

The first anodization process may be carried out by exposing Al layer 60 to an electrolytic bath containing an oxidizing acid such as sulfuric acid ($H_2SO_4$), phosphoric acid ($H_3PO_4$) oxalic acid ($C_2H_2O_4$) and/or chromic acid ($H_2CrO_4$). The electrolyte may be present, for example, in a water-based solution. The voltage applied during the first anodization process may be selected based on the electrolyte composition. For example, the voltage may range from 5-25V for an electrolyte based on sulfuric acid, 10-80V for an electrolyte based on oxalic acid, and 50-150V for an electrolyte based on phosphoric acid. The particular voltage used will depend on the desired pore diameter (and the suitability of such voltage for the electrolyte).

Aano-pore diameter ($d_{p1}$) also is related to the nature of the electrolyte used. Accordingly, an electrolyte may be selected to achieve a particular desired nano-pore diameter ($d_{p1}$). As non-limiting examples, nano-pores 82 of the following sizes may be obtained using the following electrolytes: nano-pore diameters ($d_{p1}$) of about 20 nanometers may be obtained using $H_2SO_4$ (in a water-based solution) as the electrolyte; nano-pores diameters ($d_{p1}$) of about 40 nanometers may be obtained using $C_2H_2O_4$(in a water-based solution) as the electrolyte; and nano-pores diameters ($d_{p1}$) of about 120 nanometers may be obtained using $H_3PO_4$ (in a water-based solution) as the electrolyte.

In one example, nano-structure template 80 is formed by anodization of the second oxidizable material layer 60 in a 4% solution of oxalic acid ($C_2H_2O_4$), at a voltage of 30 Volts until substantially the entire Al layer is consumed. For a suitably thick Al layer, the resulting nano-structure template 80 will define nano-pores 82 that are approximately 30 nanometers wide, and that will allow oxidation of underlying first oxidizable material layer 50. The nano-structure template should have a template height ($h_T$) sufficient to allow complete growth of a nano-pillars 40 (including both stem portions 42 and cap portions 44) within the nano-pores, as described below.

After the first anodization process, the nano-pore diameter ($d_{p1}$) may be further tuned to a target nano-pore diameter by anisotropic etching, or other suitable process. Anisotropic etching may be performed using diluted phosphoric acid (5 vol. %). The time for etching may vary, depending, at least in part, upon the desirable average diameter for the final pores. The temperature for etching may also depend upon the process, the etching rate, and the etchant used.

In some examples, prior to performing the first anodization process, the first oxidizable material layer may be patterned to precisely define locations of nano-pores 82 in the resulting nano-structure template 80. Patterning may be accomplished via any suitable technique. The patterned layer (not shown) is then anodized, for example, by employing the patterned layer as the anode of an electrolytic cell. A suitable amount of voltage and current is then applied to the electrolytic cell for an amount of time to completely anodize the patterned layer in accordance with the first anodization process described above. This can result in substantially uniformly spaced nano-structures where the variance in spacing between nano-structures differs by less than 1% (for nanometer scale dimensions).

Figure 4C:
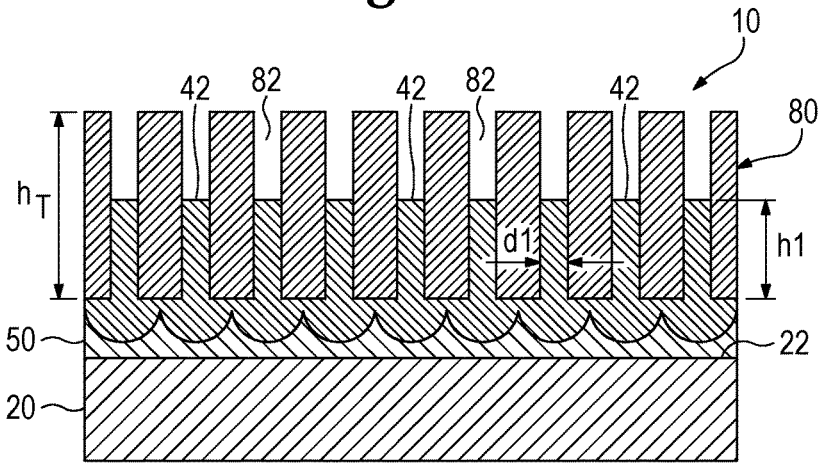

Referring now to FIG. 4C, nano-pores 82 may be partially filled to define nano-pillar stem portions 42. Nano-pillar stem portions may be formed via a second anodization process selected to partially anodize the underlying first oxidizable material layer 50 (e.g., the Ta layer). Such second anodization process will grow an oxide from the first oxidizable material, the oxide forming in the nano-pores 82 of the nano-structure template 80 from the bottom up. Where the first oxidizable material layer 50 is formed of a metal such as tantalum (Ta), the resulting oxide may take the form of a dense oxide such as anodic tantalum pentoxide ($Ta_2O_5$).

The second anodization process may be accomplished, for example, using a process similar to the first anodization process described above. More specifically, the first oxidizable material layer 50 is anodized by employing the first oxidizable material layer as the anode of an electrolytic cell to achieve a desired oxidation of the first oxidizable material.

For oxidation of tantalum, non-limiting examples of electrolyte may include solutions containing citric acid ($C_6H_8O_7$), oxalic acid ($C_2H_2O_4$), boric acid ($H_3BO_3$), ammonium pentaborate ($(NH_4)_2B_{10}O_{16}\times 8H_2O$), and/or ammonium tartrate ($H_4NO_2CCH(OH)CH(OH)CO_2NH_4$). It is to be understood that this type of anodization forms a dense oxide, where both the interface between the remaining first oxidizable material and the formed oxide, and the interface between the formed oxide and the electrolyte are planarized.

During anodization of the first oxidizable material layer 50 (in this example, a tantalum layer), the formed oxide (in this example, tantalum pentoxide ($Ta_2O_5$)) grows through the individual nano-pores 82 defined in nano-structure template 80 to form a nano-pillar stem portion 42 in each nano-pore. The orientation of nano-pillar stem portions 42 is generally controlled by the orientation of the nano-pores 82. In the present example, the nano-pillar stem portions 42 are substantially orthogonal to the surface 22 of substrate 20.

The expansion coefficient of a material to be oxidized is defined as the ratio of oxide volume to consumed material volume. The expansion coefficient for oxidation of tantalum (Ta) is approximately 2.3. Accordingly, in the present example, due to the significant expansion of tantalum pentoxide ($Ta_2O_5$), and the fact that the resulting oxide ($Ta_2O_5$) is dense, the nano-pores 82 are filled from the bottom up. It will be understood that although the first oxidizable material is tantalum (Ta) in the present example, other materials with an expansion coefficient greater than 1 would similarly allow the oxidizable material to squeeze into the nano-pores 82 of template 80.

As indicated, the grown oxide will partially fill nano-pores 82 of nano-structure template 80 to define nano-pillar stem portions 42. The geometries of the nano-pillar stem portions 42 will substantially conform to the geometries of corresponding nano-pores 82, within which the nano-pillar stem portions are growing. Nano-pillar stem portions 42 thus may take the form of substantially uniform cylindrical columns, substantially orthogonal to substrate surface 22, and substantially uniformly spaced across the substrate surface.

In the present example, each nano-pillar stem portion has a substantially uniform stem thickness (indicated as stem diameter (d1)) that corresponds to the nano-pore diameter ($d_{p1}$). Nano-pillar stem portions 42 are grown to a stem height (h1) that is less than template height ($h_T$) so as to allow subsequent growth of nano-pillar cap portions 44. As shown, some residual first oxidizable material will remain beneath the grown oxide after the second anodization process (FIG. 4C). This residual first oxidizable material may subsequently be used to grow nano-pillar cap portions 44.

The geometry and/or dimensions of the nano-pillar stem portions 42 may further be controlled by adjusting one or more parameters of the anodization process. For example, the stem height (h1) will depend on the anodization voltage applied to the first oxidizable material layer 50 during its anodization. In some examples, nano-pillar stem portions are formed by anodizing the first oxidizable material at a first voltage corresponding to a target nano-pillar stem portion height.

In one example, nano-pillar stem portions having a stem height (h1) of 90 nanometers (at a stem diameter of approximately 30 nanometers) may be formed by anodization of Ta layer 50 in a 0.1% solution of citric acid ($C_6H_8O_7$), at a current density of 2 mA/cm$^2$ until voltage reaches 55V, and for 5 minutes more at 55V. It will be appreciated that stem height (h1) may be tuned to a target stem height by selecting a corresponding anodization voltage. For example, nano-pillar stem portions having a stem height of 155 nanometers may be formed by anodization of Ta layer 50 in a 0.1% solution of citric acid ($C_6H_8O_7$ at a current density of 2 mA/cm$^2$ until voltage reaches 100V, and for 5 minutes more at 100V.

Figure 4D:
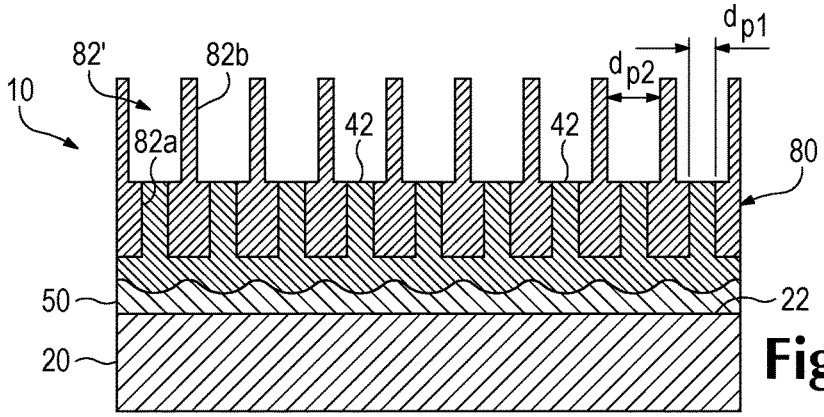

As indicated in FIG. 4D, once the nano-pillar stem portions are grown to the target stem height (h1), the nano-pores 82 may be re-shaped to define re-shaped nano-pores 82' with separate stem-forming sections 82*a* and cap-forming sections 82*b*. In the depicted example, the nano-pores remain substantially unchanged in stem-forming sections 82*a*, but are broadened in cap-forming sections 82*b*, thereby providing for subsequent formation of nano-pillar cap portions 44 that are wider than previously formed nano-pillar stem portions 42. As indicated, the re-shaped nano-pores 82' have a first width (indicated as original nano-pore diameter ($d_{p1}$)) in stem-forming sections 82*a*, and a second, different width (indicated as modified nano-pore diameter ($d_{p2}$) in cap-forming sections 82*b*. The modified nano-pore diameter ($d_{p2}$) is greater than the original nano-pore diameter ($d_{p1}$).

In some examples, nano-pillars 82 are re-shaped by broadening unfilled sections of the nano-pores 82 (the sections of the nano-pores above the formed stem portions 42). Such broadening may be achieved by selective etching of the nano-structure template 80. Selective etching may be accomplished by employing an etchant solution configured to etch the exposed areas of porous oxide forming the nano-structure template 80 (e.g., anodic porous alumina, $Al_2O_3$) at a rate that is substantially higher than the etch rate for the oxide of the first oxidizable material (e.g., anodic tantalum pentoxide ($Ta_2O_5$)).

In one example, porous alumina nano-structure template 80 (with nano-pores that are approximately 30 nanometers wide) is etched in a 5% solution of phosphoric acid ($H_3PO_4$) at a temperature of 30° C. for approximately 15 minutes to broaden the nano-pores to a modified nano-pore diameter ($d_{p2}$) of approximately 60 nanometers. In another example, the porous alumina nano-structure template 80 is etched in a 5% solution of phosphoric acid ($H_3PO_4$) at a temperature of 30° C. for approximately 30 minutes to broaden the nano-pores to a modified nano-pore diameter ($d_{p2}$) of approximately 80 nanometers. It thus will be appreciated that the width of the broadened sections (cap-forming sections 82*b*) may be tuned to a target width by selecting an etch duration corresponding to the target width. The target width may be selected to accommodate formation of nano-pillar cap portions suitable to serve as anchors for mechanically securing a cover layer to the substrate 20, as will be described further below.

Figure 4E:
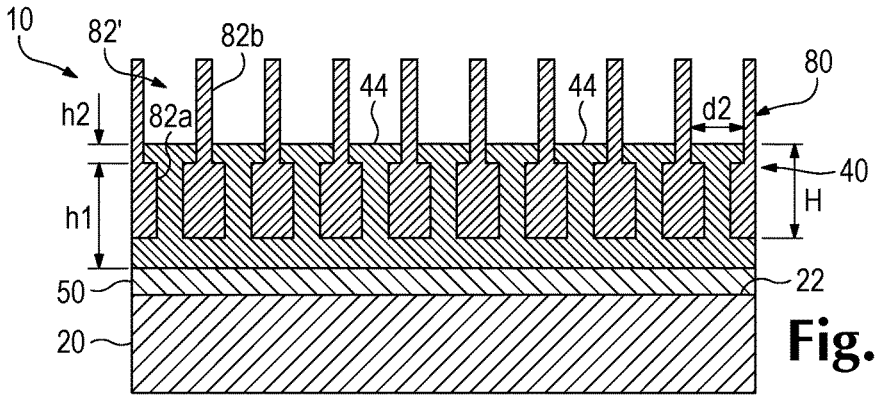

Referring now to FIG. 4E, it will be seen that the cap-forming sections 82*b* of re-shaped nano-pores 82' may be at least partially filled to define nano-pillar cap portions 44 contiguous with nano-pillar stem portions 42. In some examples, the nano-pillar cap portions may be formed via a third anodization process selected to anodize the residual first oxidizable material (e.g., the remaining Ta layer) to continue the process of growing oxide into the (now) re-shaped nano-pores 82'.

As described generally above, the third anodization process will grow oxide into the re-shaped nano-pores 82' from the bottom up. The resulting oxide thus will cause previously formed oxide to grow from the stem-forming sections 82*a* into the cap-forming sections 82*b*. The third anodization process may be substantially the same as the second anodization process, but at an anodization voltage corresponding to a target nano-pillar cap portion height.

More specifically, the first oxidizable material layer 50 is again anodized by employing the first oxidizable material layer as the anode of an electrolytic cell, and applying a suitable amount of an anodization voltage and current to the first oxidizable material layer to achieve a desired oxidation. As described above, non-limiting examples of electrolyte for oxidation of tantalum (Ta) include solutions containing citric acid ($C_6H_8O_7$), oxalic acid ($C_2H_2O_4$), boric acid ($H_3BO_3$), ammonium pentaborate ($(NH_4)_2B_{10}O_{16}\times 8H_2O$), and/or ammonium tartrate ($H_4NO_2CCH(OH)CH(OH)CO_2NH_4$). The electrolyte may be present, for example, in a water-based solution.

Again, anodization of the Ta layer will be understood to form a dense oxide (in this example, tantalum pentoxide ($Ta_2O_5$)), where both the interface between the remaining first oxidizable material and the formed oxide, and the interface between the dense oxide and the electrolyte are planarized.

Figure 4F:
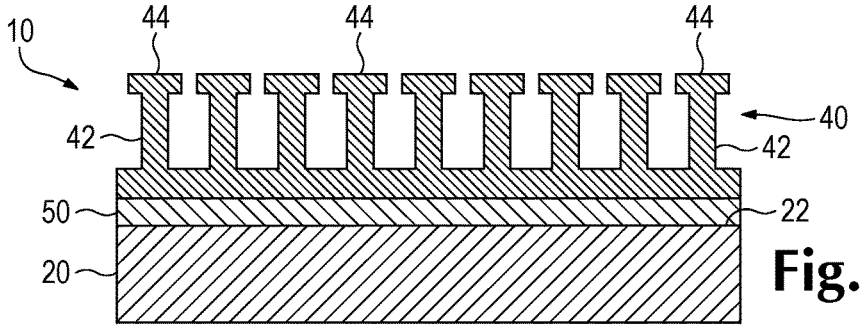

Because orientation of nano-pillars is generally controlled by the orientation of the re-shaped nano-pores 82', where the re-shaped nano-pores are orthogonal to surface 22 of substrate 20, the fully grown nano-pillar stem portions 42 and nano-pillar cap portions 44 are substantially orthogonal to surface 22 of substrate 20 (shown in FIG. 4F). It also will be appreciated that the cap portions 44 take the form of substantially uniform cylindrical columns, conforming to the shape of cap-forming sections 82*b*.

In the present example, each nano-pillar cap portion 44 has a substantially uniform cap thickness (indicated as cap diameter (d2)) that corresponds to the nano-pore diameter ($d_{p2}$). Nano-pillar cap portions 42 are grown to a cap height (h2), providing nano-pillars of overall height (H), where H=h1+h2. As shown, some residual first oxidizable material will remain beneath the grown oxide after the second anodization process (FIG. 4C).

Nano-pillar cap portions having a cap height (h2) of approximately 100 nanometers (at a cap diameter (d2) of approximately 60 nanometers) may be formed by anodization of Ta layer 50 in a 0.1% solution of citric acid ($C_6H_8O_7$), at a current density of 2 mA/cm$^2$ until voltage reaches 200V, and for 5 minutes more at 200V. Cap height (h2) may be tuned to a different target cap height by selecting a different final anodization voltage.

In FIG. 4F, the nano-structure template 80 is removed to expose the fully formed capped nano-structures 40. The nano-structure template 80 may be removed using a second selective etching process that will remove the nano-structure template 80 without deleteriously affecting the nano-pillars 40, or other features of article 10. In one example, the selective etching may be performed using a selective etchant containing $H_3PO_4$ (92 g), $CrO_3$ (32 g) and $H_2O$ (200 g), at approximately 95° C. It has been found that the example tantalum pentoxide ($Ta_2O_5$) nano-pillars 40 can withstand this particular etching process for more than one hour, while the example anodic porous alumina ($Al_2O_3$) nano-structure template 80 is etched away at a rate of about 1 micron per minute. Other selective etchants are also contemplated, dependent on the particular characteristics of the nano-structures.

Figure 4G:
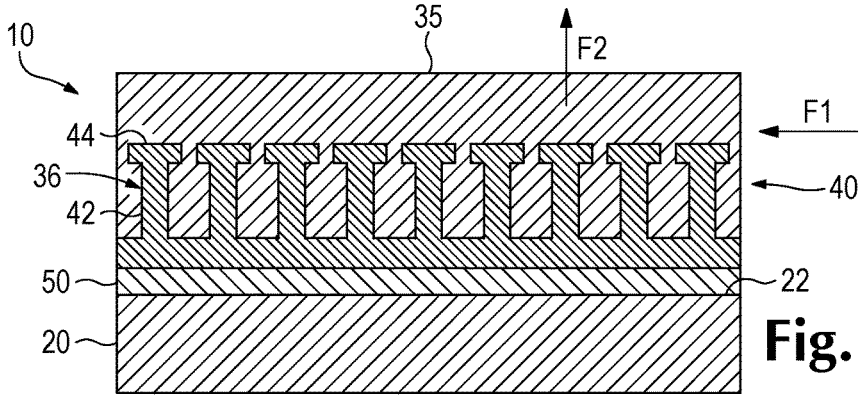

As indicated in FIG. 4G, a cover layer 35 may be applied to the nano-structured surface. The cover layer typically is applied as a flowable material of suitable viscosity to allow flow of the material between and around nano-structures 40. In some embodiments, the cover layer may be formed of SU-8, a curable epoxy that has been shown to provide excellent adhesion with tantalum pentoxide ($Ta_2O_5$). SU-8 also is suitably flowable to allow flow of material between and around nano-structures 40 prior to solidification.

Once applied, the flowable material (e.g., SU-8) is solidified, establishing a cover layer 35 that may chemically bond to the surface of substrate 20. The increased surface area of the nano-structured surface provides for enhanced chemical bonding between cover layer 35 and substrate 20. As indicated, the nanostructures also provide a mechanical anchor between the cover layer and the substrate, an interface region 36 of the cover layer being interwoven with the nano-structured surface of the substrate. The projecting nano-structures (both stem portions and cap portions) will oppose shear forces (indicated by arrow F1) between the cover layer and the substrate. The cap portions will oppose forces normal to the substrate (indicated by arrow F2).

Nano-structured surfaces such as those described herein provide excellent adhesive properties, particularly in wet environments, where interfaces are more inclined to fail. For example, shear strength of an interface between an adhesive cover layer (EMS 357-243-2 manufactured by Engineered Materials Systems, Inc.) and an LCP/PPS plastic substrate with tantalum pentoxide ($Ta_2O_5$) nano-structures will not be appreciably affected by ink soak (at 70° C.) for 2 weeks, or even 4 weeks. For a surface coated with tantalum, but without tantalum pentoxide nano-structures, shear strength of the SU-8/tantalum interface may decrease by as much as 70% or more after ink soak (at 70 degrees) for 2 weeks.

Figure 5:
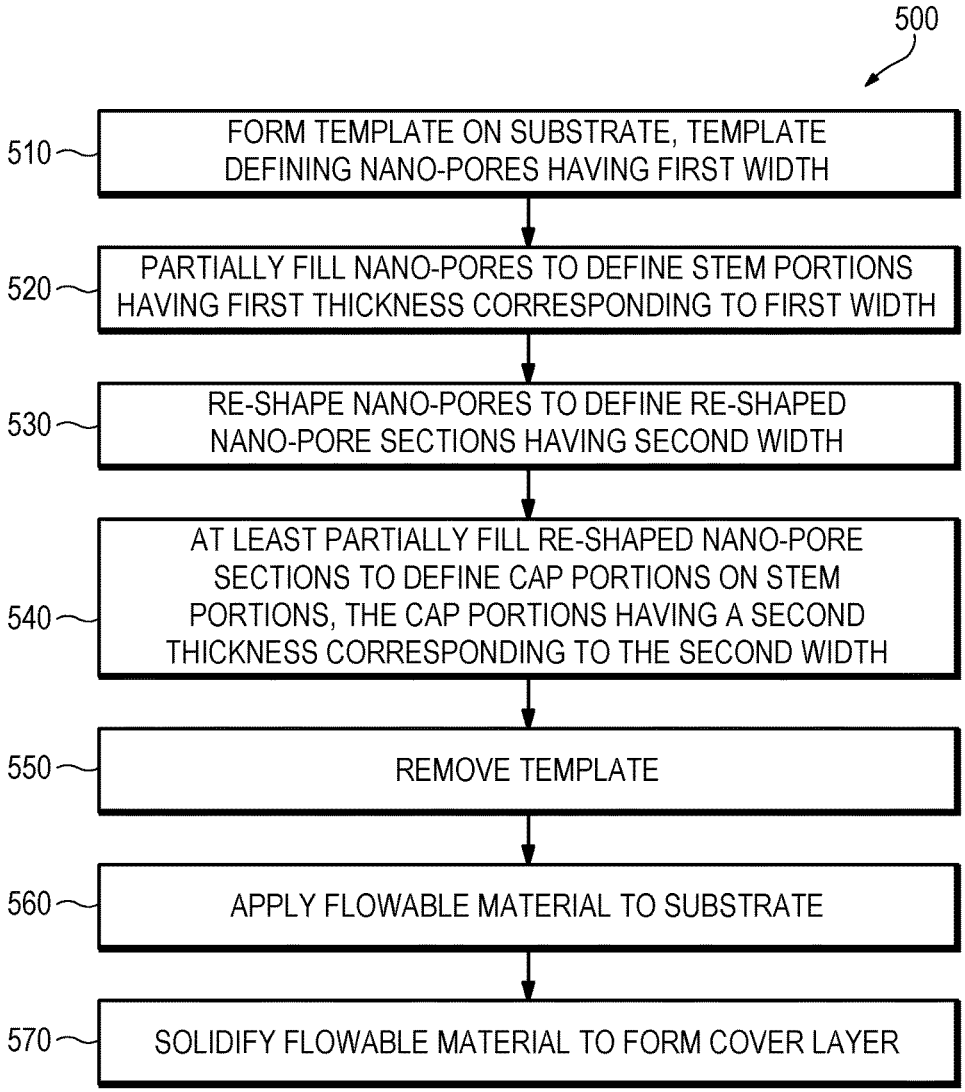
FIG. 5 is a flowchart showing a method of adhering a cover layer to an article in accordance with an embodiment of the present invention.

FIG. 5 shows a high-level flowchart 500 of a method of adhering a cover layer to a substrate, as described herein. The method generally includes: 1) forming an array of nano-structures on a substrate; 2) applying a flowable material to the substrate, the flowable material substantially enveloping the nano-structures on the substrate; and 3) solidifying the flowable material to form a cover layer on the substrate, the cover layer being anchored to the substrate via the nano-structures.

More particularly, at 510, a template is formed on the substrate, the template defining nano-pores having a first width. The template may be formed by anodizing a layer of oxidizable material on the substrate. At 520, the nano-pores are partially filled to define nano-pillar stem portions having a first thickness corresponding to the first width of the nano-pores. The nano-pillar stem portions may be formed by anodizing a layer of another oxidizable material disposed on the substrate, beneath the template, to grow an oxide into the nano-pores of the template.

At 530, the nano-pores are re-shaped to define re-shaped nano-pore sections having a second width greater than the first width. Re-shaping the nano-pores may include selective etching of nano-pores sections that do not include nano-pillar stem portions. At 540, the re-shaped nano-pores are at least partially filled to define nano-pillar cap portions on the stem portions, the cap portions having a second thickness corresponding to the second width of the re-shaped nano-pore sections. The nano-pillar cap portions may be formed by further anodizing the layer of another oxidizable material disposed beneath the template, to grow oxide into the re-shaped nano-pore sections. At 550, the template is removed. Removal of the template will reveal fully formed integral nano-pillars including stem portions and cap portions.

At 560, a flowable material is applied to the substrate, the flowable material flowing between the nanostructures, and substantially enveloping the nano-structures on the substrate. At 570, the flowable material is solidified (e.g., by curing) to form a cover layer on the substrate, the cover layer being mechanically anchored to the substrate via the nano-structures. In some embodiments the cover layer also may be chemically anchored to the substrate via chemical bond between the flowable material and the nano-structures upon solidifying the flowable material.

Anodizing the first oxidizable material may include anodizing the first oxidizable material at a first voltage corresponding to a target nano-pillar stem portion height. Similarly, further anodizing the first oxidizable material may include further anodizing the first oxidizable material at a second voltage corresponding to a target nano-pillar cap portion height. Broadening unfilled sections of the nano-pores may include etching of the substrate in an etchant solution configured to etch the porous oxide at a substantially higher etch rate than the oxide of the first oxidizable material.

Although the present invention has been described with reference to certain representative examples, various modifications may be made to these representative examples without departing from the scope of the appended claims.

What is claimed is:

1. A method of adhering a cover layer to a substrate, the method comprising:

forming an array of nano-structures on a substrate, including;

forming a template on the substrate, the template defining nano-pores having a first width;

partially filling the nano-pores to define stems of the nano-structures each having a first thickness corresponding to the first width; then re-shaping the nano-pores to define re-shaped nano-pores having a second width greater than the first width;

at least partially filling the re-shaped nano-pores to define caps of the nano-structures each having a second thickness corresponding to the second width; and removing the template;

applying a flowable material to the substrate, the flowable material substantially enveloping the nano-structures on the substrate; and solidifying the flowable material to form a cover layer on the substrate, the cover layer being anchored to the substrate via the nano-structures.

2. The method of claim 1, wherein partially filling the nano-pores includes:

forming a layer of a first oxidizable material; and anodizing the layer of first oxidizable material to grow oxide from the first oxidizable material into the nano-pores.

3. The method of claim 2, wherein at least partially filling the re-shaped nano-pores includes further anodizing the first oxidizable material to grow oxide into the re-shaped nano-pores.

4. The method of claim 3, wherein forming a template includes:

forming a layer of a second oxidizable material; and anodizing the layer of second oxidizable material to define the nano-pores.

5. The method of claim 1, wherein forming an array of nano-structures on a substrate includes forming a first set of nano-structures on a first region of the substrate and forming a second set of nano-structures on a second region of the substrate orthogonal to and intersecting the first region such that the cover layer is locked in place upon solidifying the flowable material.

6. A method of adhering a cover layer to a substrate, the method comprising:

forming multiple nano-pores on a substrate;

partially filling the nano-pores to define a stem of each of multiple nano-structures;

enlarging the unfilled part of each nano-pore;

at least partially filling the enlarged part of each nano-pore to define a cap on each stem;

exposing the cap and stem of each nano-structure;

covering the exposed cap and stem of each nano-structure with a flowable material; and solidifying the flowable material.

7. The method of claim 6, wherein;

the substrate is formed from silicon, glass, quartz, alumina, or a combination thereof;

the nano-structures comprise an anodized tantalum oxide; and the flowable material comprises an epoxy.

8. The method of claim 7, wherein partially filling the nano-pores includes:

forming a layer of tantalum on the substrate; and anodizing the tantalum to grow tantalum oxide into the nano-pores.

9. The method of claim 8, wherein at least partially filling the enlarged nano-pores includes further anodizing the tantalum to grow tantalum oxide into the enlarged nano-pores.

10. The method of claim 6, comprising:

anodizing a layer of oxidizable material to define the nano-pores; and wherein exposing the cap and stem of each nano-structure comprises removing the oxidizable material.

11. A method of adhering a cover layer to a substrate, the method comprising:

depositing a first oxidizable material onto the substrate;

depositing a second oxidizable material onto the first oxidizable material;

anodizing the second oxidizable material to form a porous oxide having nano-pores in the porous oxide;

anodizing the first oxidizable material to grow an oxide of the first oxidizable material into the nano-pores and form a nano-structure stem;

etching the porous oxide to enlarge the nano-pores;

anodizing the first oxidizable material to grow the oxide into the enlarged nano-pores and form a nano-structure cap on the nano-structure stem;

removing the porous oxide to expose the nano-structures extending from the substrate;

applying a flowable material to the substrate and covering the nano-structures; and solidifying the flowable material to form a cover layer on the substrate, the cover layer being anchored to the substrate via the nano-structures.

12. The method of claim 11, wherein;

the substrate includes a first region and a second region orthogonal to and intersecting the first region; and the nano-structures and cover layer are formed on the first and second regions of the substrate such that the cover layer is locked in place upon solidifying the flowable material.

* * * * *